United States Patent [19]

Cassidy

[11] Patent Number: 4,607,984

[45] Date of Patent: Aug. 26, 1986

[54] APPARATUS AND METHOD FOR MINE APPLICATION

[75] Inventor: Bruce A. Cassidy, Richmond, Ohio

[73] Assignee: Republic Corporation, Century City, Calif.

[21] Appl. No.: 654,129

[22] Filed: Sep. 25, 1984

[51] Int. Cl.[4] ..... E21D 20/02; E21D 21/00; F16B 33/04

[52] U.S. Cl. ..... 405/261; 405/259; 411/5; 411/11

[58] Field of Search ..... 405/259-261; 411/1-5, 9-11, 82, 258, 302-304; 52/698, 704

[56] References Cited

U.S. PATENT DOCUMENTS

| | | | |
|---|---|---|---|
| 2,748,824 | 6/1956 | Brill | 411/302 X |
| 3,967,455 | 7/1976 | Conway | 61/45 B |
| 3,979,918 | 9/1976 | Vidler | 61/45 B |
| 4,023,373 | 5/1977 | Hipkins | 61/45 B |
| 4,051,683 | 10/1977 | Koval | 61/45 B |
| 4,122,681 | 10/1978 | Vass et al. | 405/261 |
| 4,132,080 | 1/1979 | Hansen | 405/261 |
| 4,347,020 | 8/1982 | White et al. | 405/260 |
| 4,477,209 | 10/1984 | Hipkins | 411/2 X |
| 4,501,515 | 2/1985 | Scott | 405/261 X |

*Primary Examiner*—Cornelius J. Husar
*Assistant Examiner*—Nancy J. Stodola
*Attorney, Agent, or Firm*—Fleit, Jacobson, Cohn & Price

[57] ABSTRACT

An apparatus and method for anchoring a bolt in a rock formation is disclosed, and includes a rebar assembly adapted for use in a bore hole and an elongated bolt threadedly engaged to the end of the rebar. A threadable sleeve is securely affixed in an orifice, forged in the end of the rebar, at a predetermined point adjacent the orifice threaded portion. The end of the bolt abuts the sleeve upon assembly, thereby causing the bolt and the rebar assembly to rotate together upon application of a torque to the bolt. This rotational movement effects mixing of bonding material which is placed in the bore hole ahead of the rebar assembly. As the mixed bonding material begins to harden, rotation of the rebar assembly is resisted. Upon application to the bolt of a torque in excess of a predetermined torque, the bolt will thread the sleeve located in the rebar orifice by cutting threads therein, thereby causing relative rotational movement between the rebar and the bolt. the resin mixture then bonds the rebar assembly to the rock formation, thereby resisting downward movement of the rebar and allowing the bolt to be tensioned upon further rotation.

6 Claims, 5 Drawing Figures

APPARATUS AND METHOD FOR MINE APPLICATION

BACKGROUND OF THE INVENTION

This invention relates to an apparatus and method for anchoring a bolt in a rock formation, and, more particularly, to a reinforcing bar assembly adapted for use with a bonding material.

It is well-known in the art of mine roof support to utilize systems which combine a mechanical or conventional bolt and resin anchoring. A typical reinforcing bar (rebar) system includes a rebar with external threads on one end, and externally threaded bolt carrying plate for engagement with the roof surface, and an internally threaded coupling device for joining the bolt and rebar. The diameters of both the rebar and bolt threaded portions usually differ such that their advancement in the coupling is limited. While the rebar is completely engaged with the coupling, the bolt normally advances only a fraction of the way in the coupling, its axial movement arrested by a stop means in the form of a shearable pin or deformed thread.

Once assembled, this system is inserted into a bore hold behind a resin capsule so as to rupture the capsule causing the enclosed resin and catalyst to engulf the rebar and the coupling. Mixing of the resin components is accomplished by rotating the bolt, thereby causing the rebar/coupling assembly similarly to rotate. The mixture is then permitted to cure and harden. After the resin cures and hardens, rotation of the rebar and coupling is resisted, thereby allowing the torque applied by the bolt to the stop means to exceed a predetermined level. By this action, the bolt displaces the shearable pin (or overcomes the resistance of the deformed thread), thereby continuing its axial movement within the coupling. Upon continued rotation, the bolt can be tensioned in the bore hole.

One of the major shortfalls of these systems lies in the construction of the stop means. The most familiar stop means is in the form of a shearable pin which breaks upon application of the preselected torque. Severe problems exist in practice, however, in determining the proper material and associated pin dimensions for constructing a pin which reacts to stress as planned. As a result, there have been problems in the operation of these systems, with many systems failing to operate properly in actual use.

Therefore, the principal object of the present invention is to provide a method and apparatus for combining resin bonding and mechanical tensioning of a bolt in a rock formation by a rebar assembly provided with a resistance means which will thread when a torque in excess of a predetermined value is continuously applied to a bolt abutting the resistance means.

Another object is to provide a resistance means which is tapped by a bolt upon continuous application to the bolt of a torque in excess of a predetermined torque.

Still another object is to provide an apparatus which employs only two components for ease of installation and use.

SUMMARY OF THE INVENTION

The foregoing and other objects of the invention are achieved by providing an apparatus including a rebar assembly adapted for use in a bore hole and an elongated bolt threadedly engaged to the end of the rebar. A threadable sleeve is securely affixed in an orifice, forged in the end of the rebar, at a predetermined point adjacent the orifice threaded portion. The end of the bolt abuts the sleeve upon assembly, thereby causing the bolt and the rebar assembly to rotate together upon application of a torque to the bolt. This rotational movement effects mixing of bonding material which is placed in the bore hole ahead of the rebar assembly.

As the mixed bonding material begins to harden, rotation of the rebar assembly is resisted. Upon application to the bolt of a torque in excess of a predetermined torque, the bolt will thread the sleeve located in the rebar orifice by cutting threads therein, thereby causing relative rotational movement between the rebar and the bolt. The resin mixture then bonds the rebar assembly to the rock formation, thereby resisting downward movement of the rebar and allowing the bolt to be tensioned upon further rotation.

DESCRIPTION OF THE PREFERRED EMBODIMENT

Figure 1:
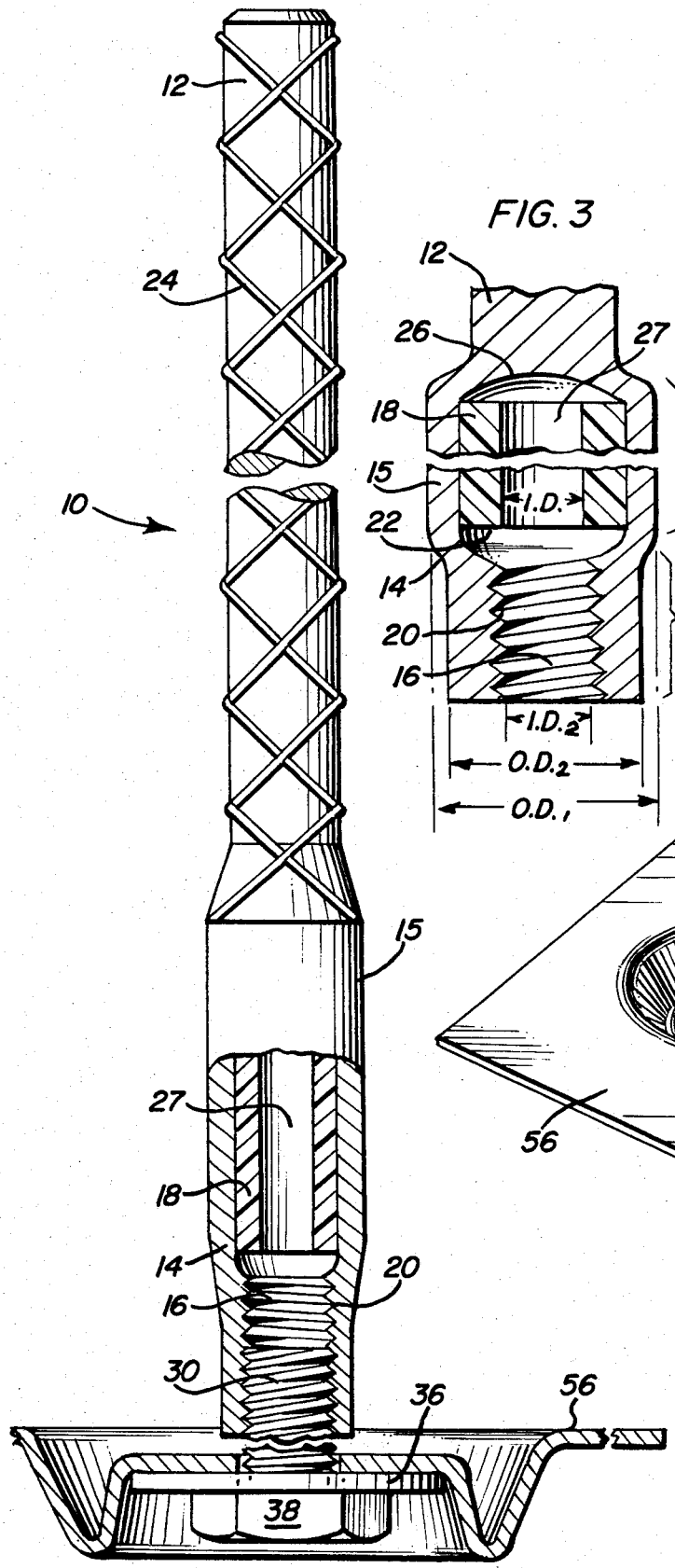
FIG. 1 is a view in partial cross section of a rebar assembly positioned on the threaded end of a bolt.

Referring now to FIGS. 1 through 5, there is shown the rebar assembly of the present invention, generally designated by the numeral 10, for anchoring a bolt in a bore hole in a rock formation. Rebar 10 comprises a first end 12 for insertion of a bore hole 50 and a second end 14 for threadedly engaging an elongated bolt 30. Rebar 10 and bolt 30, once inserted into bore hole 50, are used in combination with a bonding material (e.g., polyester resin) 40.

Rebar 10 is of unitary construction and comprises two major portions, first end 12 and second end 14. First end 12 is an elongated solid rod with a plurality of gripping projections 24 located on its surface for effectively interacting with the bonding material 40. Second end 14, with an outside diameter slightly larger than that of first end 12, also comprises two portions, top portion **14*a* and bottom portion 14*b*, and includes an orifice 16 extending throughout its entire length. The bottom portion 14*b* of orifice 16 has threads 20 which mate with bolt threads 32, while top portion 4*a* houses the resistance means in the form of a threadable sleeve 18. Sleeve 18** is preferably made from a plastic material such as nylon which is threadable upon application of a predetermined force. Alternatively, it may be constructed of soft, malleable metal which is similarly threadable.

Rebar assembly 10 is constructed from a solid rebar on one end 14 of which an orifice 16 is forged. Orifice 16, generally cylindrical as initially formed, has a non-uniform inside diameter. When sleeve 18 is dropped into orifice 16, it defines a rounded collection cavity 26 at the end of orifice 16. Once sleeve 18 is positioned in orifice top portion 14*a*, bottom portion 14*b* is reswagged to a consistent diameter. As a result of this operation, the outside diameter $OD_2$ of bottom portion 14*b* is slightly smaller than the outside diameter $OD_1$ of top portion 14*a*. The inner surface of bottom portion 14*b* is then tapped to form inner threads 20.

Sleeve 18 simply may be dropped in orifice 16 with construction of threaded bottom portion 14*b* providing the mechanism for securing sleeve 18 in place in orifice 16. Alternatively, sleeve 18 may be secured in place in orifice top portion 14*a* either mechanically or adhesively. In one embodiment, sleeve 18 is mechanically secured in position by peening the rebar outer surface 15 at several points around top portion 14*a*, thereby deforming the metal. Because the outside diameter of sleeve 18 approximately corresponds to the inside diameter of the orifice top portion 14*a*, the peening of the outer surface 15 holds sleeve 18 in place in orifice 16. Finally, or in combination with the above-noted procedure, sleeve 18 may be held in place by an adhesive applied to the sleeve outer surface and the orifice 16 inner wall.

Figure 3:
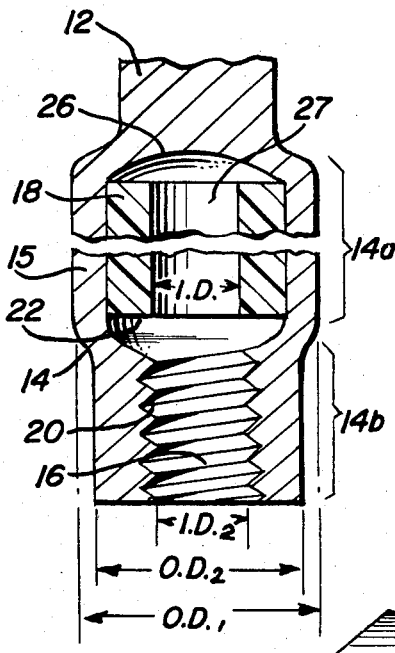
FIG. 3 is an enlarged sectional view of the bottom portion of the rebar assembly of FIG. 1.
Figure 2:
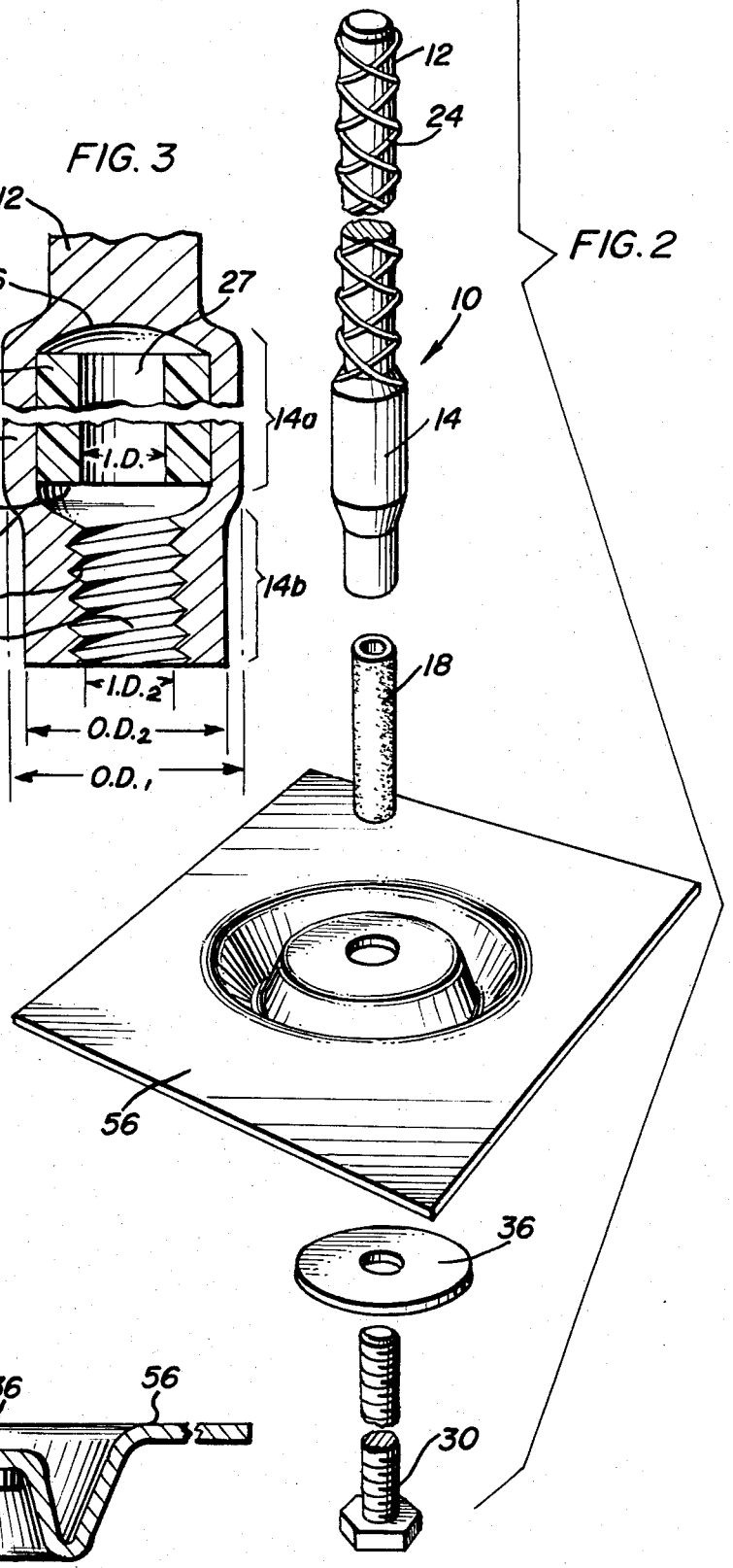
FIG. 2 is a fragmentary, exploded view of the rebar assembly of FIG. 1.

As shown in FIG. 3, the inside diameter $ID_1$ of sleeve 18 approximately corresponds to the inside diameter $ID_2$ of the threaded bottom portion 14*b* of orifice 16 (i.e., the minor diameter of bolt 30). Therefore, as bolt threads 32 mate with rebar threads 20 and bolt 30 progresses through orifice 16, bolt 30 will encounter resistance of its axial movement when it abuts sleeve 18. In particular, the bolt threads 20 will abut sleeve end face 22 as they attempt to pass through the orifice top portion 14*a*. With its axial movement thus abated, further rotation of the bolt 30 will cause simultaneous rotation of rebar 10.

Sleeve 18 is designed such that, upon application to the bolt 30 of a torque in excess of a predetermined torque, bolt threads 32 tap the sleeve 18, thereby threadedly engaging sleeve 18 and allowing relative rotation between rebar 10 and bolt 30. Bolt 30 then passes through sleeve aperture 27, cutting grooves in sleeve 18 and carrying the shavings from the inner wall of the sleeve 18 in collection cavity 26.

Figure 4:
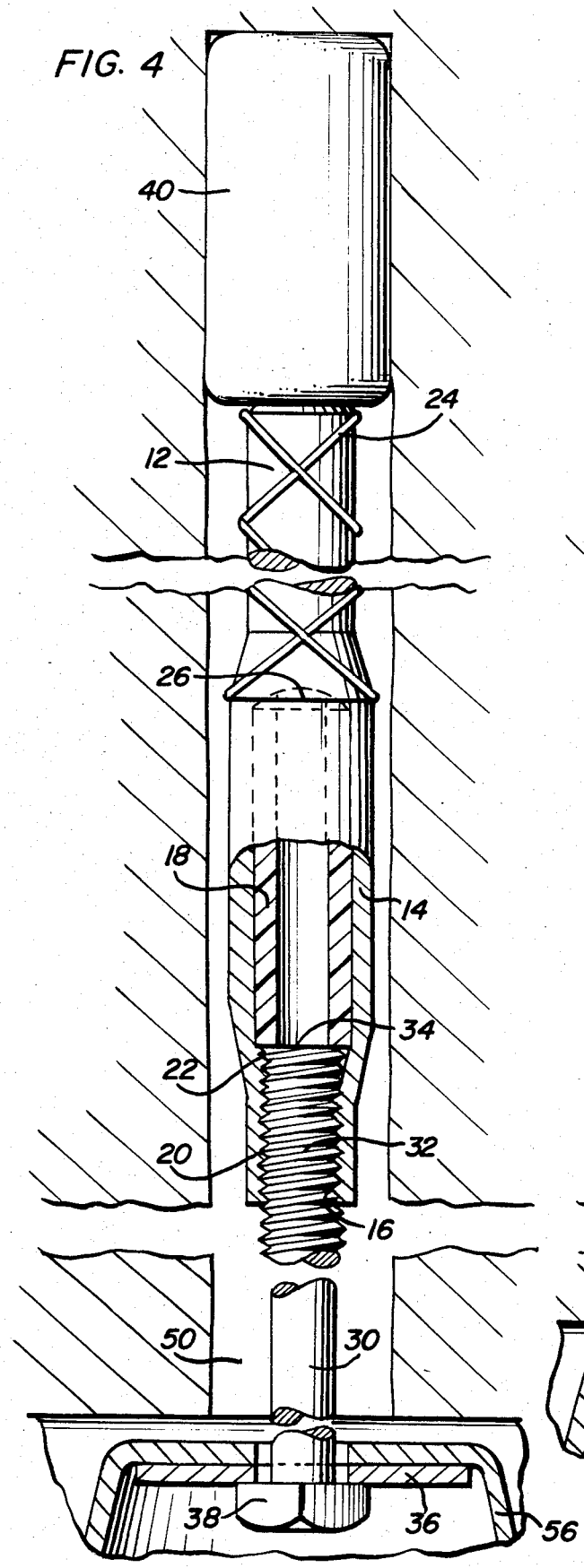
FIG. 4 is a view of the bolt/rebar assembly in place in a bore hole in a rock formation, showing bonding material at the end of the bore hole in readiness for mixing.
Figure 5:
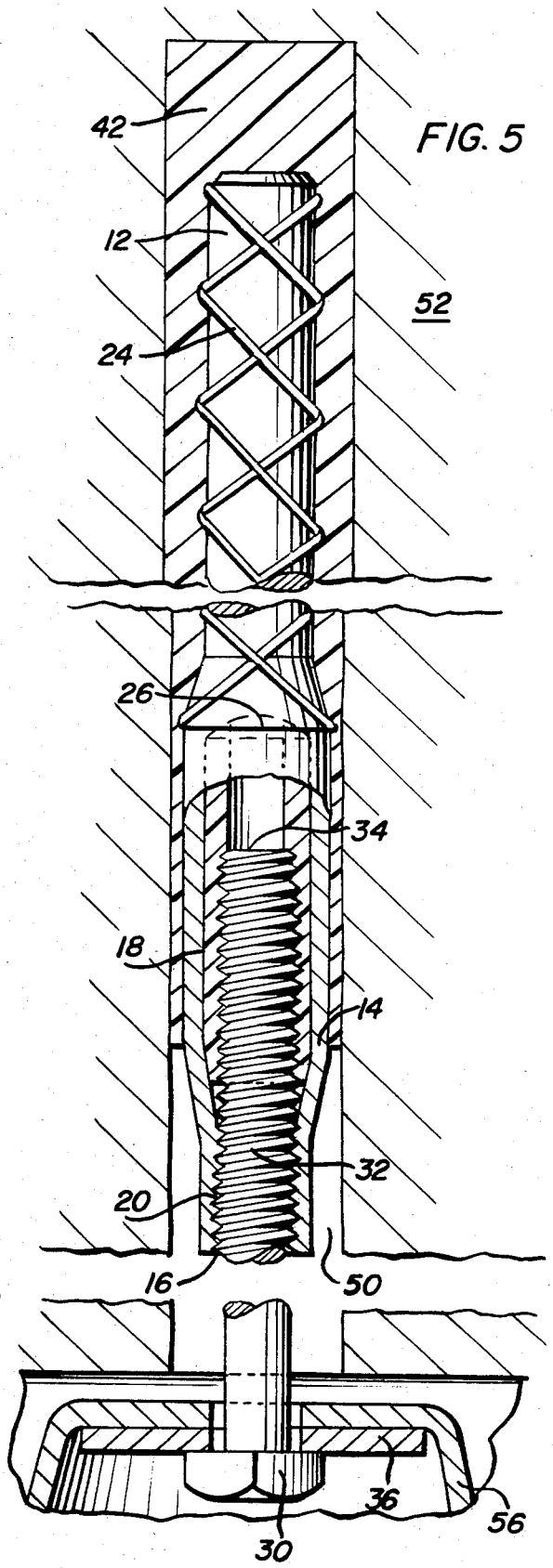
FIG. 5 is a view similar to FIG. 4 illustrating the final position of the assembly in the bore hole wherein the threadable sleeve has been tapped by the bolt.

FIGS. 4 and 5 illustrate the method of anchoring the rebar 10 in a bore hole 50 of a rock formaltion 52. First, a compartmentalized capsule 40 of unmixed bonding material (e.g., polyester resin) is placed in bore hole 50 ahead of rebar 10. With rebar 10 engaging the threaded end 32 of bolt 30 such that bolt threads 32 abut the deformable sleeve 18, the entire apparatus is thrust upward into bore hole 50, thereby rupturing capsule 40. The resin then permeates the bore hole 50, surrounding rebar 10 and extending down as far as rebar second end 14 where the increased diameter of second end 14 inhibits any further downward flow of the resin mixture 42 within bore hole 50. Once the capsule 40 is ruptured, bolt 30 is pushed into hole 50 such that support plate 56 rests against rock formation 52 at the entrance to bore hole 50 with the washer 36 between the bolt head 38 and the support plate 56. Bolt 30 is then rotated in a predetermined direction by means of the bolt head 38. Because sleeve 18 prevents relative rotation between the bolt 30 and rebar 10, rotation of the bolt 30 causes simultaneous rotation of rebar 10 and consequent mixing of the resin 42.

The resin capsule 40 preferably includes a resin (e.g., polyester) and a catalyst, both of which are well-known in the art. As the bolt 30 is rotated, the resin and catalyst are mixed to form a curable resin mixture 42 which generally polymerizes at room temperature. Mixing is effected by the rotation of botl 30 in one direction for approximately 10 seconds. The mixture 42 is then permitted to settle and cure for approximately 20 seconds, after which the bolt 30 is torqued. This mixing procedure may vary depending on the resin used. During this mixing process, the resin mixture 42 flows into the fissures of the rock formation 52 surrounding the bore hole 50, thereby reinforcing the rock formation 52.

As the resin mixture 42 begins to harden about rebar 10, it exerts a force thereon resisting rotation. When a torque in excess of a predetermined torque is applied to bolt 30 in the same direction as the initial rotation, bolt threads 32 tap into sleeve 18, cutting grooves on the sleeve 18 inside surface. Due to the resistance supplied by the hardening resin mixture 42, bolt 30 and rebar 10 are allowed to rotate relative to one another, causing bolt 30 to pass through orifice top portion 14*a* as it taps sleeve 18. As this occurs, bolt 30 passes through a portion of the length of sleeve 18, carrying with it the shavings formed by the threading action of the bolt 30 on sleeve 18.

As the resin mixture 42 cures to its final solid state, rebar 10 is held firmly in place in the bore hole 50. Upon further rotation, the bolt 30 is placed under an increasing tension in the bore hole 50 with support plate 56 exerting an upward force on rock formation 52 and lifting it by up to several inches. By bonding the rebar 10 to the rock formation 52, the resin mixture 42 resists slippage of the rebar 10, thereby allowing the bolt 30 to be maintained in tension.

Although a particular embodiment of the present invention has been illustrated and described, it will be apparent to those skilled in the art that various changes and modifications can be made without departing from the spirit and scope of the present invention. For example, the bonding agent, rather thaan being a resin, could be a cement and water activated hydraulic grout or the like. Therefore, it is the intent to encompass within the claims all such changes and modifications that fall within the scope of the present invention.

What is claimed is:

1. An apparatus for anchoring a bolt in a rock formation comprising:

an elongated reinforcing bar, having first and second ends, adapted for use in a bore hole in said rock formation;

said reinforcing bar second end defining an orifice having first and second portions, said second portion being threaded, said threads defining an inside diameter, and said first portion housing a threadable sleeve having a smooth inner surface and defining an inner aperture, said orifice and said aperture being coaxial;

an elongated bolt having first and second ends, said first end being externally threaded to engage said orifice second portion and said second end having a bolt head and a roof support plate adjacent thereto;

said bolt first end threaded into and extending through said orifice second portion and abutting said threadable sleeve thereby preventing axial movement of said bolt upon application of torque beyond a predetermined point in said orifice and causing said reinforcing bar and said bolt to rotate together; and said threadable sleeve being tapped by said bolt threaded first end upon application to said bolt of a torque in excess of a predetermined torque, the threads of said bolt cutting away grooves in said sleeve inner surface, thereby allowing relative rotation between said bolt and said bar to permit said bolt to tap into said sleeve and said roof support plate to be drawn adjacent the rock formation, said bolt being placed under tension in said bore hole.

2. The apparatus of claim 1, wherein the sleeve has an inside diameter approximately the same as the outside diameter of the bolt first end so that only the threads of the bolt first end come into contact with said sleeve.

3. The apparatus of claim 1, wherein said sleeve is made of nylon.

4. The apparatus of claim 1, wherein said sleeve is made of plastic.

5. The apparatus of claim 1, wherein said sleeve is made of a soft, malleable material.

6. A method of anchoring a bolt in a rock formation comprising the steps of:

inserting a resin capsule in a bore hole in the rock formation;

positioning a reinforcing bar, having first and second ends, in said bore hole such that said first end abuts the resin capsule, said second end defining an orifice having first and second portions;

threading the end of an elongated bolt in said orifice bottom portion;

preventing axial movement of the bolt beyond a predetermined point within said orifice by a threadable sleeve defining an inner aperture and disposed in said orifice first portion such that said orifice and said aperture are coaxial, said sleeve abutting said bolt at said predetermined point, thereby causing said bolt and said bar to rotate together upon application of a torque to said bolt in a predetermined direction to effect mixing of said resin in said bore hole;

tapping said threadable sleeve by the bolt threaded end upon application to said bolt of a torque in excess of a predetermined torque, the threads of said bolt cutting away grooves in said sleeve, said mixed resin preventing rotation of said bar; and tensioning the bolt by continuing to rotate said bolt having a roof support plate adjacent a bolt head in said predetermined direction, said plate being drawn adjacent the rock formation.

* * * * *